US006471582B1

(12) United States Patent
Tucker

(10) Patent No.: US 6,471,582 B1
(45) Date of Patent: Oct. 29, 2002

(54) ADAPTER FOR COUPLING AIR DUCT TO FAN-DRIVEN VENT

(75) Inventor: Darren F. Tucker, Houston, TX (US)

(73) Assignee: Applied Optoelectronics, Inc., Sugar Land, TX (US)

( * ) Notice: Subject to any disclaimer, the term of this patent is extended or adjusted under 35 U.S.C. 154(b) by 0 days.

(21) Appl. No.: 09/929,671

(22) Filed: Aug. 14, 2001

(51) Int. Cl.[7] ..... F24F 3/16
(52) U.S. Cl. ..... 454/187; 55/385.2; 55/471
(58) Field of Search ..... 454/187, 228, 454/236, 292, 296, 338; 55/385.2, 471, 473

(56) References Cited

U.S. PATENT DOCUMENTS 1,820,779 A * 8/1931 Carson ..... 165/103
2,189,895 A * 2/1940 Grutzner ..... 236/38
3,552,294 A * 1/1971 Goldberg
4,191,543 A * 3/1980 Peters ..... 422/122
4,549,472 A * 10/1985 Endo et al. ..... 454/187
4,693,175 A * 9/1987 Hashimoto ..... 454/187
5,462,484 A * 10/1995 Jung et al. ..... 454/187

* cited by examiner

*Primary Examiner*—Harold Joyce
(74) *Attorney, Agent, or Firm*—N. Stephan Kinsella

(57) ABSTRACT

An adapter for coupling an air duct having an air duct mating end to a fan-driven vent unit having an air intake opening. The air duct may be a circular cross sectional air duct, for example, and the vent unit may comprise a HEPA or other filter. The adapter has a first mating section compatible with the air duct mating end (e.g., circular) for coupling the adapter to the air duct mating end, and a second mating section for coupling the adapter to the air intake opening of the fan-driven vent unit. Side walls of the adapter, between or part of the first and second mating sections, have supply-relief holes for providing a supply of air to the air intake opening when the air duct provides no air supply (e.g., when it is closed off by a damper system).

24 Claims, 1 Drawing Sheet

ADAPTER FOR COUPLING AIR DUCT TO FAN-DRIVEN VENT

BACKGROUND OF THE INVENTION

1. Field of the Invention

This invention relates generally to air ducts and fan-driven vents and, in particular, to air-conditioner (A/C) air ducts and fan-driven filters used, e.g., in semiconductor fabrication cleanrooms.

2. Description of the Related Art

The following descriptions and examples are not admitted to be prior art by virtue of their inclusion within this section.

Cleanrooms are often employed in applications such as semiconductor manufacturing, in environments in which it is important to minimize external contaminants such as dust or other particles. For example, cleanrooms may be employed to house equipment used to grow and process devices such as electronics, microchips, processors, and optoelectronics, on semiconductor wafer substrates.

Cleanrooms are often designated by a numerical class. For example, a class 10,000 cleanroom is one having (depending on the standard employed) a maximum of 10,000 measured 0.5 $\mu$m or greater size particles in a cubic foot of air in the room. In cleanrooms, clean, filtered air is constantly pumped into the room through an air vent to maintain positive pressure in the room, so that air always blows out of the room. This function is typically performed by blower/filter modules (BFMs, or FBMs), which typically employ a filter, and a blower (fan), such as a venturi blower, to provide a vertical laminar flow of HEPA- or ULPA-filtered air. Air is taken into an air inlet on the top, and filtered air is blown out of a vent at the bottom of the BFM.

The filters employed by BFMs include HEPA (high efficiency particulate arrestance (or air)) and ULPA (ultra-low penetration air) filters. HEPA filters are typically rated 99.99% efficient at removing particles 0.3 microns in diameter or larger, while ULPA filters are typically rated 99.999% efficient at removing particles 0.12 microns in diameter or larger.

BFMs are manufactured by various vendors, including the Patriot High Purity HEPA Filter Blower model no. BFM 24 LPF, available from Airflotek, Inc., 2150 Northmont Pkwy., Suite H, Duluth Ga. 30096 (information available on the web at www address airflotek.com). Other BFMs include the American Cleanroom Systems Magnum 800 (M800) Motorized HEPA Filter, sold by Cintas Cleanroom Resources (information available on the web at www address cintascorp.com/clean). BFMs may be employed in both conventional or softwall cleanrooms. When installed in the former, the BFM may be installed in the ceiling grid system of the cleanroom, with the air intake taking air from the plenum.

Cleanrooms also often need to be air-conditioned (A/C) to maintain the temperature and humidity levels of the room within acceptable ranges.

In a conventional cleanroom, the entire room is maintained as a cleanroom. Air is pumped into the room via vents of BFMs, typically mounted in the ceiling, to maintain positive air pressure in the room with respect to the environment outside the room. An A/C system may also be used, instead of (or in addition to) a BFM, to perform similar function. For example, the A/C duct is run to a vent to the room, via a HEPA filter, where the A/C system fan is always on; the cooling element of the A/C system is switched on and off as desired, to maintain temperature and humidity.

In a "portable" or softwall cleanroom, a cleanroom is erected within a larger, air-conditioned room. Such a cleanroom typically consists of a frame, with a sealed top (roof), and with clear plastic "curtain" softwalls. A fan-driven filter, such as the model BFM 24 LPF described above, is typically mounted in the roof portion of the portable cleanroom. The filter constantly filters and pumps the (already air-conditioned) air in the room into the portable cleanroom, to maintain positive air pressure in the portable cleanroom with respect to the room in which it is disposed.

BRIEF DESCRIPTION OF THE DRAWINGS

Other features and advantages of the invention will become apparent upon study of the following description, taken in conjunction with the attached FIGS. 1–2.

DETAILED DESCRIPTION OF THE INVENTION

The present invention provides an adapter for use in an air supply system, such as a cleanroom air supply and filtration system. The adapter of the present invention is for coupling an A/C duct providing a supply of air-conditioned air to a fan-driven filter, such that the fan of the fan-driven filter is not subject to air starvation when the A/C supply is switched off.

Figure 1:
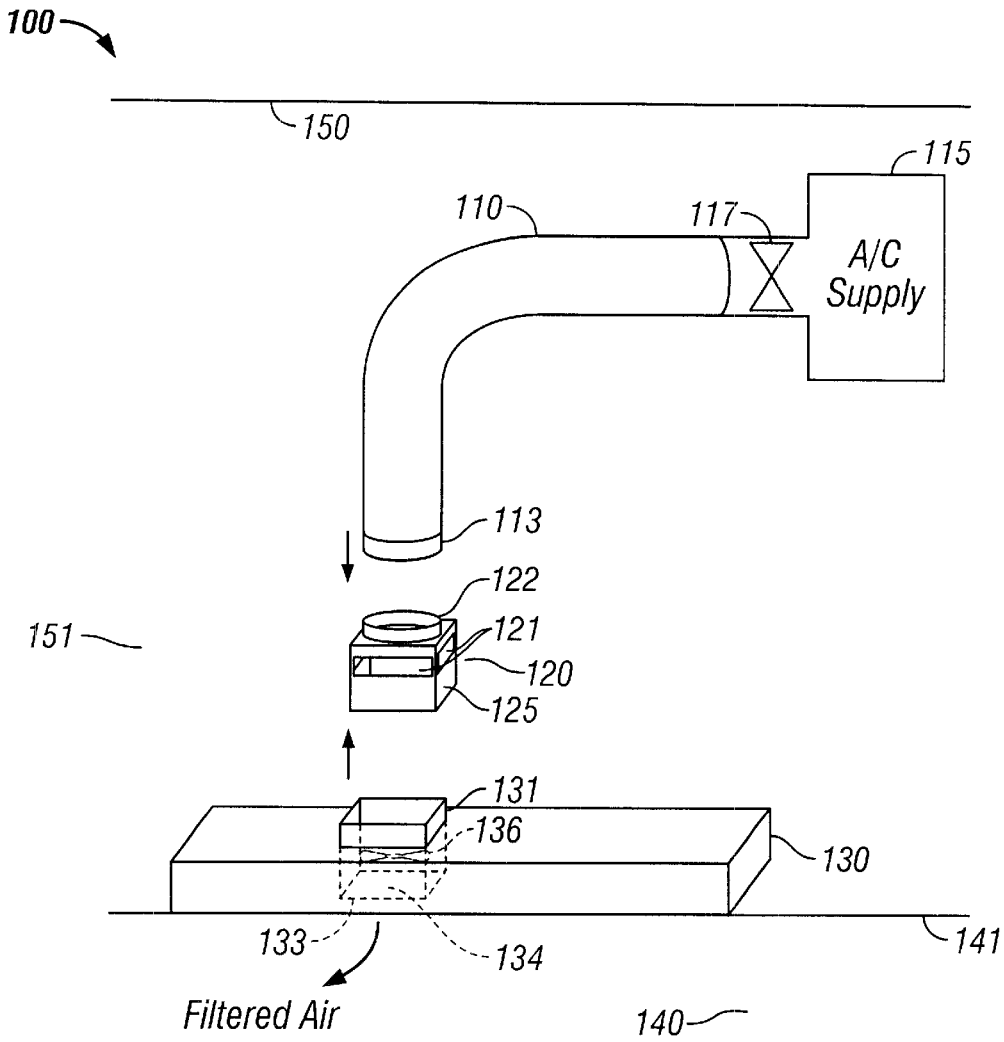
FIG. 1 a perspective, exploded view of a cleanroom air supply system having an A/C duct coupled to a fan-driven filter unit with an adapter, in accordance with an embodiment of the present invention.

Referring now to FIG. 1, there is shown a perspective, exploded view of a cleanroom air supply system 100 having an A/C duct 110 coupled to a fan-driven filter (e.g., BFM) unit 130 with an adapter 120, in accordance with an embodiment of the present invention. In an embodiment, unit 130 is mounted above or in the ceiling 141 of a cleanroom 140. A blower (fan) 136 in unit 130 is always on (i.e., preferably on whenever cleanroom conditions are desired), so that unit 130 always pumps air into the cleanroom 140 via a vent or opening 133 in its bottom side. In this manner, positive air pressure is always maintained in the cleanroom 140. The air driven by fan 136 is taken from the plenum space 151 into air intake opening 131. This air passes through filter 134, before exiting at vent 133 into cleanroom 140.

In system 100, A/C supply 115 provides some or all of the cooling and dehumidifying required by cleanroom 140, via air duct 110 (cleanroom 140, for example, might not be a portable cleanroom and thus might not have its own A/C supply). A dampening valve 117 of a dampening system selectively couples duct 110 to A/C supply 115, which is presumed to be always on. I.e., valve 117 can be open, or close, in which case air duct 110 is not in air flow communication with A/C supply 115. (In alternative embodiments, valve 117 may be partially open as well.)

Fan 136 is always on, even though air duct 110 may or may not, at various times, be providing air-conditioned air from A/C supply 115. Air duct 110 has a standard circular cross-section. The air intake opening 131 for the top filter unit 130 is typically square, and may have protruding vertical walls, as illustrated. (Alternatively, the vertical walls extending from and around air intake opening 131 may not be present, in some embodiments.)

Figure 2:
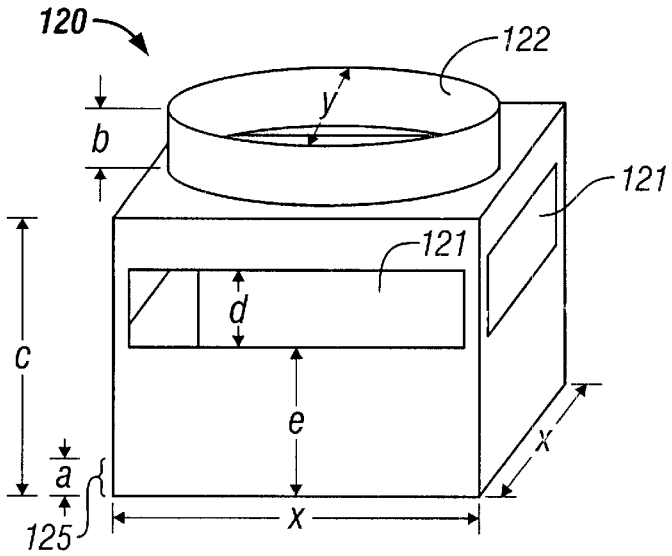
FIG. 2 is a perspective view illustrating the adapter of the system of FIG. 1 in further detail.

Adapter 120 has appropriate mating or coupling sections or means for coupling to both air duct end 113 and filter unit 130's air intake opening 131. In particular, in an embodiment, adapter 120 is a round-to-square adapter, having a top, circular mating section 122, to which may be coupled the circular cross-sectional end 113 of duct 110; and a bottom, square mating section 125, as illustrated in further detail in FIG. 2, which may be coupled to the air intake opening 131 of BFM 130. In this manner, air duct 110 can be communicatively coupled (with respect to air flow) to the air intake opening 131 of BFM 130, so that air-conditioned air is filtered and supplied to cleanroom 140 via BFM 130.

Adapter 120 also has four supply-relief openings or holes 121 in its four sides, as shown, These serve to prevent air starvation of tie fan 136 when valve 117 shuts off (completely or partially) duct 110 from A/C supply 115, by providing a supply of air to the air intake opening 131 when the air duct 110 provides no air supply. As will be appreciated, the space above the cleanroom 140 ceiling 141 is not normally the outside environment, but rather a plenum space 151 above the cleanroom and other rooms of the building containing the cleanroom, and below an even higher ceiling or roof 150. The plenum space 151 typically contains air that is not directly air-conditioned, but which may be pumped into cleanroom 140 by BFM 130.

Thus, when cleanroom 140 needs cooling and/or dehumidifying, valve 117 is open, and cooled/dehumidified air flows from A/C supply 115, through air duct 110, and through adapter 120 and the fan 136 and filter 134 of filter unit 130, to be pumped into cleanroom 140. In this way, filtered, air-conditioned air is supplied to cleanroom 140 by BFM 130. The supply relief holes 121 are preferably as small as possible, to minimize the amount of air-conditioned air leaking out of the holes, when valve 117 is open. By appropriately selecting the air flow capacity of fan 136 for a given air duct 110 air flow, and the size and positioning of supply relief holes 121 on adapter 120, any such leakage can be eliminated or minimized.

When valve 117 is not open (or is not sufficiently open), supply relief holes 121 prevent air starvation of fan 136 and permit the desired air pressure in cleanroom 140 to be maintained, by providing a source of air intake supply for BFM 130 other than air from air duct 110. In particular, when valve 117 is not open and no air-conditioned air flows from duct 110, fan 136 draws air from the plenum, through supply relief holes 121, into air intake opening 131.

In the manner described, adapter 120 may be used to couple an air duct from an A/C supply to a differently-shaped air intake opening of a blower/filter module, while permitting a combination of BFM and supply of air-conditioned air even when the A/C supply is sometimes switched off.

In an embodiment, filter unit 130 may be a model BFM 24 LPF described above, coupled to a class 10,000 cleanroom 140, with other elements of system 100 having the following dimensions or specifications. The air intake opening 131 of filter 130 is square, having vertical protruding vertical walls, having approximately 12" length sides; the vertical walls are approximately 2" high. Duct 110 is an air duct having an approximately 12" cross-sectional diameter (as does its mating end 113). In an embodiment, adapter 120 is constructed out of galvanized steel sheets having a thickness of approximately 0.6 to 1 mm, and has approximately the following dimensions indicated on FIG. 2: x=12.5"; c=10"; a=2"; d=3"; e=6"; b=3"; y=11.875". The width of the rectangular supply-relief holes or openings 121 is approximately 11".

Thus, the top, circular mating section 122 is slightly smaller in diameter than the end 113 of air duct 110, permitting coupling of the two by placing the latter over the former. The bottom, square mating section 125 is slightly larger than the air intake opening 131, thus permitting mating section 125 to be placed over the protruding vertical walls of air intake opening 131, thus coupling the two. In this manner, round-to-square adapter 120 can be used to couple duct 110 with BFM 130, with supply relief holes 121 thereof performing the useful functions described above.

As will be appreciated, the size and placement of openings 121 are selected so that sufficient air can be pulled by fan 136 from plenum 151, when valve 117 is closed, so that fan 136 is not subject to damaging or suboptimal air starvation and so that desired air pressure can be maintained in cleanroom 140. The openings 121 are preferably the smallest size possible that will satisfy these constraints, to maximize the coupling of cooled air from duct 110 to vent 133, when valve 117 is open (i.e., to minimize the amount of plenum air sucked in, along with the cooled air; or, conversely, to minimize the leakage of cooled air out of adapter 120, through holes 121, into the plenum 151). For symmetry and ease of manufacture, the openings may be on all four sides of adapter 120, as shown; but in alternative embodiments, there may be openings in fewer than all of the sides. Also, in alternative embodiments, the openings (holes) 121 may be disposed in the cylindrical section 122 which couples to duct 110, instead of in the square, four-walled section that couples to filter unit 130. In general, there is at least one wall of the adapter which has at least one supply-relief hole for providing a supply of air to the air intake opening when the air duct provides no air supply, This maybe a "side wal1" between the first and second mating sections, e.g. when they are on opposing (e.g., top and bottom) sides from one another. In other embodiments, the adapter of the invention comprises a plurality (e.g., 4) of side walls each having at least one supply-relief hole, said plurality of holes being for providing a supply of air to the air intake opening when the air duct provides no air supply.

The present invention thus provides an adapter (e.g., 120) for coupling an air duct (e.g., 110) having an air duct mating end (e.g., 113) of a first type (e.g., circular cross-section with a given diameter) to a fan-driven vent unit having a vent output and an air intake opening, where the adapter has: a first mating section (or means) (e.g., 122) compatible with the first type (e.g., it is also round, and either smaller or larger for ease of coupling), for coupling the adapter to the air duct mating end (e.g., 113); a second mating section (or means) (e.g., 125) for coupling the adapter to the air intake opening (e.g., 131) of the fan-driven vent unit; and rectangular supply-relief holes (opening) (e.g., 121) in the side walls of the adapter that are between the first and second mating sections of the adapter (preferably at a top portion of each of said walls, beneath the cylindrical first mating section), for providing a supply of air to the air intake opening when the air duct provides no air supply (e.g., because a damper/valve system has shut it off from the A/C supply). The second mating section may be the bottom portion (e.g., the bottom two inches) of the four-walled square-cross-sectional portion of the adapter beneath the cylindrical first mating section, where the walls of the four-walled portion have the openings therein at an upper portion and the second mating section at the bottom thereof. The fan-driven vent unit may be a fan-driven filter/vent unit (e.g., a BFM such as model no. BFM 24 LPF) comprising a filter (e.g., HEPA or ULPA filter) for filtering air taken into the intake opening and output at the vent output by the fan. The BFM is preferably mounted in the ceiling of a cleanroom so that the vent output pumps filtered air into the cleanroom and the supply relief holes provide a supply of air to the air intake opening from a plenum space above said ceiling. The air intake opening (e.g., 131) may comprise protruding vertical walls having a square cross section, where the second mating section of the adapter thus comprises corresponding walls having a square cross section slightly larger than that of the protruding vertical walls of the air intake opening so as to permit the second mating section to fit over the protruding vertical walls to couple the adapter to the fan-driven filter/vent unit.

An adapter in accordance with the present invention may be employed, in general, to couple an air duct (e.g., of an A/C system) having a first mating type (e.g., circular), to a fan-driven vent having a second mating type (e.g., rectangular or square). In the embodiments described above, the fan-driven vent also contains a filter, such as a HEPA filter, and is used to couple air to a cleanroom. In alternative embodiments, the room fed by the vent may not be a cleanroom, and a filter may not be utilized. For example, it may be desired to constantly provide air pressure, and to selectively provide cooled air, to a room that is not a cleanroom. In this case, no extra filtration may be needed. In such an embodiment, the vent unit's fan pumps non-air-conditioned air from the plenum space, via supply relief holes or openings, into the room, when the air supply from the air duct is not on (or not sufficiently high). When the air supply from the air duct is on and high enough, it provides the predominant source of the air pumped through the vent by the fan.

The adapter of the present invention permits cleanrooms to receive a constant source of filtered air and air pressure, combined with selective air cooling/dehumidifying (for temperature/humidity control), without having to employ an A/C system which has at least its fan always on.

In other embodiments, the first (circular) mating section 122 and second (square) mating section 125 are not necessarily on opposite (e.g. top and bottom) sides of the adapter. E.g., they may be on walls at 90 degrees from one another in an alternative embodiment.

In alternative embodiments, air ducts having mating types other than circular may be employed, and vent/filter units having mating types other than square or rectangular may be employed. In this case, an adapter of the present invention has corresponding mating types, as well as suitable supply-relief holes to permit the fan of the vent unit to avoid air starvation whenever the air duct provides no or diminished air supply. In an alternative embodiment, for example, an air intake opening on a BFM may have no protruding vertical walls as shown in FIG. 1. In such a case, the bottom mating section preferably has a cross-sectional shape similar to, but slightly larger than, that of the air intake opening (e.g., round, or square), and horizontal extended flanges that may be used to attach the adapter to the top surface of the BFM module around the outside of the air intake opening, e.g. by screws, welding, mounting clips or attachments, or other suitable mounting techniques.

In the present invention, a "non-section- 112(6) means" for performing some function refers to any means that performs the function, as opposed to a section 112(6) means (i.e., "means for" elements under 35 U.S.C. section 112, paragraph 6), which literally cover only the corresponding stucture, material, or acts described in the specification and equivalents thereof, which support the means for element.

The present invention, therefore, is well adapted to carry out the objects and attain the ends and advantages mentioned, as well as others inherent therein. While the invention has been depicted and described and is defined by reference to particular preferred embodiments of the invention, such references do not imply a limitation on the invention, and no such limitation is to be inferred. The invention is capable of considerable modification, alteration and equivalents in form and function, as will occur to those ordinarily skilled in the pertinent arts. The depicted and described preferred embodiments of the invention are exemplary only and are not exhaustive of the scope of the invention. Consequently, the invention is intended to be limited only by the spirit and scope of the appended claims (if any), giving full cognizance to equivalents in all respects.

What is claimed is:

1. A system for providing a supply of air to a room, the system comprising:

(a) a fan-driven vent unit having a vent output open to the room and an air intake opening;

(b) an air duct for providing an air supply, the air duct having an air duct mating end; and (c) an adapter for coupling the air duct to the fan-driven vent unit, the adapter is mounted in a plenum space above a ceiling outside the room, the space containing air, the adapter comprising:

a first mating section for coupling the adapter to the air duct mating end;

a second mating section for coupling the adapter to the air intake opening of the fan-driven vent unit; and at least one wall having at least one supply-relief hole, open to said plenum space, for providing air from the plenum space outside the room to the air intake opening when the air duct does not provide the air supply.

2. The system of claim 1, wherein the at least one wall comprises a plurality of side walls between the first and second mating sections, each said side wall having at least one supply-relief hole open to said space.

3. The system of claim 1, wherein the fan-driven vent unit is a fan-driven filter/vent unit comprising a filter for filtering air taken into the air intake opening and output at the vent output into the room.

4. The system of claim 3, wherein the filter is a high efficiency particulate arrestance (HEPA) filter.

5. The system of claim 3, wherein the filter is an ultra-low penetration air (ULPA) filter.

6. The system of claim 3, wherein the fan-driven filter/vent unit is mounted in a ceiling of the room, wherein the vent output pumps filtered air into the room and the at least one supply relief hole is open to said plenum space and provides air from said plenum space to the air intake opening when the air duet does not provide the air supply.

7. The system of claim 1, wherein:

the air duct and the air duct mating end have a circular cross section and the air duct mating end has a circular cross section having a first diameter; and the first mating section comprises a cylindrical section having a circular cross section having a diameter slightly smaller than the first diameter so as to permit the air duct mating end to fit over the first mating section to couple the air duct to the adapter.

8. The system of claim 7, wherein:

the fan-driven vent unit is a fan-driven filter/vent unit comprising a vent output and a filter for filtering air taken into the intake opening and output at the vent output by the fan;

the fan-driven filter/vent unit is mounted in a ceiling of the room and the adapter is mounted in a plenum space above the ceiling, wherein the vent output pumps filtered air into the room and the at least one supply relief hole is open to said plenum space and provides air from said plenum space to the air intake opening when the air duct does not provide the air supply;

the air intake opening comprises protruding vertical walls having a square cross section; and the second mating section comprises walls having a square cross section slightly larger than that of the protruding vertical walls of the air intake opening so as to permit the second mating section to fit over the protruding vertical walls to couple the adapter to the fan-driven filter/vent unit.

9. The system of claim 8, wherein:

the air intake opening is square and the square cross section of the protruding vertical walls have sides approximately 12" in length;

the protruding vertical walls are approximately 2" high;

the adapter is constructed from galvanized steel sheeting approximately 1 mm thick;

the cylindrical section of the first mating section has a cross-sectional diameter of approximately 11.875";

the cylindrical section is mounted on a top of a four-walled section having a square cross-section, the four-walled section having a rectangular supply-relief hole at a top portion of each of said walls, each hole having a height of approximately 3" and a width of approximately 11", the four-walled section comprising, at a bottom portion beneath the supply-relief holes, the second mating section, wherein the square cross-sectional walls of the four-walled section and the second mating section are approximately 12.5" in length an the walls of the four-wall section are approximately 10" high.

10. The system of claim 1, wherein:

the air duct and the air duct mating end have a circular cross section and the air duct mating end is round;

the air intake opening is square; and the first mating section comprises a cylindrical section having a circular cross section for coupling the air duct to the adapter and the second mating section comprises walls having a square cross section for coupling the adapter to the air intake opening, whereby the adapter is a round-to-square adapter.

11. A system for providing a supply of air to a room, the system comprising:

(a) a fan-driven vent unit having a vent output open to the room and an air intake opening;

(b) an air duct for providing an air supply, the air duct having an air duct mating end; and (c) an adapter for coupling the air duct to the fan-driven vent unit, the adapter is mounted in a plenum space above a ceiling outside the room, the space containing air, the adapter comprising:

first mating means for coupling the adapter to the air duct mating end;

second mating means for coupling the adapter to the air intake opening of the fan-driven vent unit; and supply-relief means for providing air from the space outside the room to the air intake opening when the air duct does not provide the air supply.

12. The system of claim 11, wherein the fan-driven vent unit is a fan-driven filter/vent unit comprising a vent output and a filter for filtering air taken into the intake opening and output at the vent output by the fan, wherein the vent unit is mounted in a ceiling of the room, wherein the vent output pumps filtered air into the room and the supply relief means provides air from said plenum space to the air intake opening when the air duct does not provide the air supply.

13. The system of claim 11, wherein:

the air duct and the air duct mating end have a circular cross section and the air duct mating end has a circular cross section having a first diameter;

the first mating means comprises a cylindrical section having a circular cross section having a diameter slightly smaller than the first diameter so as to permit the air duct mating end to fit over the first mating section to couple the air duct to the adapter.

14. The system of claim 13, wherein:

the fan-driven vent unit is a fan-driven filter/vent unit comprising a vent output and a filter for filtering air taken into the intake opening and output at the vent output by the fan;

the vent unit is mounted in a ceiling of the room, wherein the vent output pumps filtered air into the room and the supply relief means provides air from said plenum space to the air intake opening when the air duct does not provide the air supply;

the air intake opening comprises protruding vertical walls having a square cross section; and the second mating moans comprises walls having a square cross section slightly larger than that of the protruding vertical walls of the air intake opening so as to permit the second mating section to fit over the protruding vertical walls to couple the adapter to the fan-driven filter/vent unit.

15. The system of claim 11, wherein:

the air duct and the air duct mating end have a circular cross section and the air duct mating end is round;

the air intake open is square; and the first mating means comprises a cylindrical section having a circular cross section for coupling the air duct to the adapter and the second mating means comprises walls having a square cross section for coupling the adapter to the air intake opening, whereby the adapter is a round-to-square adapter.

16. The system of claim 11, wherein the supply-relief means comprises at least one wall having at least one supply-relief hole.

17. The system of claim 16, wherein the at least one wall comprises a plurality of side walls between the first and second mating means, each said side wall having at least one supply-relief hole.

18. A method for coupling an air duct for providing an air supply and having an air duct mating end to a fan-driven vent unit having an air intake opening and a vent output open to a room, the method comprising the steps of:

(a) mounting an adapter in a plenum space above a ceiling outside the room, the space containing air, the adapter comprising a first mating section, a second mating section, and at least one wall having at least one supply-relief hole open to said space;

(b) coupling the first mating section of the adapter to the air duct mating end;

(c) coupling the second mating section of the adapter to the air intake opening of the fan-driven vent unit; and (d) providing, with said at least one supply-relief hole, air from the plenum space outside the room to the air intake opening when the air duct does not provide the air supply.

19. The method of claim 18, wherein the at least one wall comprises a plurality of side walls between the first and second mating sections, each said side wall having at least one supply-relief hole open to said space.

20. The method of claim 18, wherein the fan-driven vent unit is a fan-driven filter/vent unit comprising a filter for filtering air taken into the air intake opening and output at the vent output into the room.

21. The method of claim 20, wherein the filter is a high efficiency particulate arrestance (HEPA) filter.

22. The method of claim 20, further comprising the steps of:

mounting the fan-driven filter/vent unit in a ceiling of the room;

the ceiling, wherein said at least one supply relief hole is open to said plenum space;

pumping, with the vent output, filtered air into the room; and providing, with the at least one supply relief holes, air from said plenum space to the air intake opening when the air duct does not provide the air supply.

23. The method of claim 18, wherein:

the air duct and the air duct mating end have a circular cross section and the air duct mating end has a circular cross section having a first diameter;

the first mating section comprises a cylindrical section having a circular cross section having a diameter slightly smaller than the first diameter so as to permit the air duct mating end to fit over the first mating section to couple the air duct to the adapter;

the fan-driven vent unit is a fan-driven filter/vent unit comprising a vent output and a filter for filtering air taken into the intake opening and output at the vent output by the fan;

the air intake opening comprises protruding vertical walls having a square cross section; and the second mating section comprises walls having a square cross section sightly larger than that of the protruding vertical walls of the air intake opening so as to permit the second mating section to fit over the protruding vertical walls to couple the adapter to the fan-driven filter/vent unit;

the method comprising the further steps of:

mounting the fan-driven filter/vent unit in a ceiling of the room;

above the ceiling, wherein said at least one supply relief hole is open to said plenum space;

pumping, with the vent output, filtered air into the room; and providing, with the at least one supply relief holes, air from said plenum space to the air intake opening when the air duct does not provide the air supply.

24. The method of claim 18, wherein:

the air duct and the air duct mating end have a circular cross section and the air duct mating end is round;

the air intake opening is square; and the first mating section comprises a cylindrical section having a circular cross section for coupling the air duct to the adapter and the second mating section comprises walls having a square cross section for coupling the adapter to the air intake opening, whereby the adapter is a round-to-square adapter.

* * * * *